US006897622B2

(12) United States Patent
Lister

(10) Patent No.: US 6,897,622 B2
(45) Date of Patent: May 24, 2005

(54) INCREMENTAL COLOR BLENDING ILLUMINATION SYSTEM USING LEDS

(75) Inventor: Stephen Lister, Long Beach, CA (US)

(73) Assignee: Mattel, Inc., El Segundo, CA (US)

( * ) Notice: Subject to any disclaimer, the term of this patent is extended or adjusted under 35 U.S.C. 154(b) by 36 days.

(21) Appl. No.: 10/610,808

(22) Filed: Jun. 30, 2003

(65) Prior Publication Data

US 2004/0263094 A1 Dec. 30, 2004

(51) Int. Cl.[7] ..... G05F 1/00
(52) U.S. Cl. ..... 315/291; 315/307; 315/224
(58) Field of Search ..... 315/209 R, 219, 315/224, 244, 291, 307, 151, 158, 159

(56) References Cited

U.S. PATENT DOCUMENTS

| | | | | |
|---|---|---|---|---|
| 3,654,710 A | | 4/1972 | Barnard | 434/258 |
| 4,282,680 A | | 8/1981 | Zaruba | 446/270 |
| 4,305,223 A | | 12/1981 | Ho | 446/392 |
| 4,338,742 A | | 7/1982 | Outtrim et al. | 446/368 |
| 4,363,081 A | | 12/1982 | Wilbur | 362/98 |
| 4,373,722 A | * | 2/1983 | Kite et al. | 463/6 |
| 4,600,974 A | | 7/1986 | Lew et al. | 362/102 |
| 4,820,229 A | | 4/1989 | Spraggins | 446/26 |
| 4,874,343 A | | 10/1989 | Rosenthal | 446/175 |
| 4,915,666 A | | 4/1990 | Maleyko | 446/242 |
| 4,971,592 A | | 11/1990 | Carcia, III | 446/219 |
| 4,991,066 A | | 2/1991 | McCowan | 362/464 |
| 5,054,778 A | | 10/1991 | Maleyko | 473/570 |
| 5,118,319 A | | 6/1992 | Smith et al. | 446/219 |
| 5,139,455 A | | 8/1992 | Israel | 446/219 |
| 5,269,719 A | | 12/1993 | Klawitter et al. | 446/485 |
| 5,316,293 A | | 5/1994 | Hamilton | 473/570 |
| 5,375,044 A | | 12/1994 | Guritz | 362/104 |
| 5,575,554 A | | 11/1996 | Guritz | 362/103 |
| 5,743,796 A | | 4/1998 | Orak et al. | 463/9 |
| 5,854,542 A | | 12/1998 | Forbes | 315/291 |
| 5,947,789 A | | 9/1999 | Chan | 446/219 |
| 6,016,038 A | | 1/2000 | Mueller et al. | 315/291 |
| 6,095,661 A | | 8/2000 | Lebens et al. | 362/184 |
| 6,150,774 A | | 11/2000 | Mueller et al. | 315/291 |
| 6,190,229 B1 | | 2/2001 | Nadel et al. | 446/219 |
| 6,371,638 B1 | | 4/2002 | Zingale et al. | 362/565 |
| 6,431,937 B1 | | 8/2002 | Lau et al. | 446/175 |
| 6,747,420 B2 | * | 6/2004 | Barth et al. | 315/291 |
| 2002/0105286 A1 | * | 8/2002 | Brownell | 315/291 |

* cited by examiner

*Primary Examiner*—Don Wong
*Assistant Examiner*—Jimmy Vu
(74) *Attorney, Agent, or Firm*—Roy A. Ekstrand

(57) ABSTRACT

A plurality of color LEDs are commonly coupled to a source of operating supply. A plurality of switching transistors and current limiting resistors in series therewith are coupled to the color LEDs to control the current there through in response to switching transistor conduction. A microcontroller having an input signal and a plurality of outputs configured in response thereto is operatively coupled to the plurality of switching transistors to control the conduction and thereby illumination output of the color LEDs to achieve incremental color blending.

7 Claims, 2 Drawing Sheets

INCREMENTAL COLOR BLENDING ILLUMINATION SYSTEM USING LEDS

FIELD OF THE INVENTION

This invention relates generally to illumination systems and particularly to those utilized in products such as toys, games or the like.

BACKGROUND OF THE INVENTION

The development of light emitting diodes (LEDs) has provided a dramatic improvement in the availability of low-cost, efficient illumination sources. Such low-cost illumination sources have made possible which would otherwise be significantly larger of substantially increased in cost and power consumption. The power required to provide illumination using LEDs is dramatically reduced from that provided by other typical illumination devices such as incandescent lights or the like.

In addition to their advantages of lower cost and lower power requirements, LEDs also enjoy substantial advantages in their rapid response in transitioning between on and off states. Unlike incandescent lamps or the like which have a relatively slow transition time between illumination and non-illumination, LEDs are substantially more rapid in transition then can be perceived by the human eye. Thus, LEDs appear to the observer to be instantly switched on or off.

A still further advantage found in LEDs is their compatibility with digital electronic control circuits. One of the more interesting applications of LEDs as illumination devices is found in the art generally referred to as "color blending". This art derives its general name from the capability of differently colored light emitting diodes being used to provide resulting colors which are combinations or "blends" of the individual LEDs in the group. Perhaps the common form of color blending using LEDs arises in systems which utilize one or more LEDs of each of the three primary colors, red, blue and green. In this use, another advantage of LEDs is evident in that the typical small size of LEDs allows their close positioning to enhance the color blending phenomenon. A simple color blending system may utilize three LEDs one of each primary color (red, blue and green) formed in a closely spaced arrangement. As the proportions of each color LED output are varied, the resulting blended color of illumination may be carefully controlled. In higher power arrays pluralities of each LED color output may be grouped or arranged as needed and controlled in a similar fashion.

Not surprisingly, the extended development and improvement of LEDs has motivated practitioners in the art to utilize such color blending LED illumination systems in a variety of devices. For example, U.S. Pat. No. 6,016,038 and its parent U.S. Pat. No. 6,150,774 both issued to Mueller et al. and both entitled MULTICOLORED LED LIGHTING METHOD AND APPARATUS in which an array of LEDs is controlled by a processor to alter the brightness and/or color of the generated light. Example is given utilizing pulse-width modulated signals. The resulting illumination may be controlled by a computer program to provide complex, pre-designed patterns of light in virtually any environment.

U.S. Pat. No. 6,095,661 issued to Lebens et al. sets forth a METHOD AND APPARATUS FOR AN LED FLASHLIGHT in which an elongated flashlight body supports a power supply and controller together with an on/off switch.

The illumination head of the flashlight supports a plurality of LEDs operatively coupled to the controller. In one embodiment, differently colored LEDs are selectively powered in groups to provide a light output color using color blending.

U.S. Pat. No. 5,947,789 issued to Chan sets forth a TOY SWORD HAVING A VARIABLE COLOR ILLUMINATED BLADE featuring a handle section and a translucent blade section. The handle section houses a light source for illuminating an interior of the blade section. A switch energizes the light source and a multicolored filter is disposed between the light source and the translucent blade selection to provide color selection illumination of the blade section.

U.S. Pat. No. 6,190,229 issued to Nadel et al. sets forth a FIBER OPTIC ENHANCED FIGURINE ASSEMBLY generally resembling a horse having a quantity of fiber optic hair disposed as the main and tail of the horse. A power source within the body of the horse energizes a plurality of LEDs which illuminate the fiber optic bundles.

U.S. Pat. No. 6,431,937 issued to Lau et al. sets forth a TOY SYSTEM having a baton-like signal transmitter and a doll which includes an inferred signal receiver for receiving inferred signals from the transmitter. The doll produces sound such as songs or the like in response to signals received by the signal transmitter.

U.S. Pat. No. 3,654,710 issued to Barnard sets forth a SELECTIVELY ILLUMINATABLE TOY having a housing supporting a plurality of switches, a battery power source and a plurality of illuminatable lights.

U.S. Pat. No. 5,854,542 issued to Forbes sets forth FLASHING AND DIMMING FLUORESCENT LAMPS FOR A GAMING DEVICE operated continuously during normal operation and then flashed to signal promotional operation. Alternatively, an illumination lamp may be dimmed during normal operation and then operated at full brightness during promotional activities.

U.S. Pat. No. 4,305,223 issued to Ho sets forth a MAGIC EYEBALL having a plurality of LEDs, a power apparatus for supplying electrical power to said LEDs and a plurality of switches which are placed under suitable parts of a toy body. By means of the touch activation of the switches the LEDs are able to emit a changeable light.

U.S. Pat. No. 4,363,081 issued to Wilbur sets forth ILLUMINATED GREETING CARDS having a first portion formed of sheet stock as a display panel defining one or more apertures. LEDs are disposed behind the display panel to provide illumination through the apertures. A printed circuit board controls the LEDs and the light produced thereby.

A number of additional devices utilizing some form of selective illumination is provided in additional patents such as U.S. Pat. No. 4,373,722 issued to Kite et al., U.S. Pat. No. 4,338,742 issued to Outtrim et al., U.S. Pat. No. 4,282,680 issued to Zaruba, U.S. Pat. No. 4,600,974 issued to Lew et al., U.S. Pat. No. 4,820,229 issued to Spraggins, U.S. Pat. No. 4,874,343 issued to Rosenthal, U.S. Pat. No. 4,915,666 issued to Maleyko, U.S. Pat. No. 4,971,592 issued to Carcia, III. and U.S. Pat. No. 4,991,066 issued to McCowan.

Still further examples of illuminated apparatus generally related to the present invention is found in the following U.S. Pat. Nos. 5,054,778; 5,118,319; 5,139,455; 5,269,719; 5,316,293; 5,375,044; 5,575,554; 5,743,796 and 6,371,638.

Despite the substantial development of lighting devices and particularly the substantial development of illumination systems using LEDs, there remains nonetheless a continuing need in the art for more low-cost, effective and efficient LED color blending systems which are particularly well suited to use in lower cost toys and game products.

SUMMARY OF THE INVENTION

Accordingly, it is general object of the present invention to provide an improved lower cost and efficient color blending illumination systems suitable for use with LEDs. It is a more particular object of the present invention to provide an improved color-blending illumination system using LEDs which is particularly well suited to effective coupling to digital electronic devices.

In accordance with the present invention there is provided an incremental color-blending illumination system comprising: a plurality of color LEDs each having a first electrode coupled to a source of operation supply and a second electrode; a plurality of transistor switches; a plurality of resistors coupling the transistor switches to the second electrodes; and a microcontroller having a plurality of outputs coupled to the plurality of switching transistors, the micro controlled providing incremental color blending of light produced by the color LEDs by selectively activating one or more of the switching transistors.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
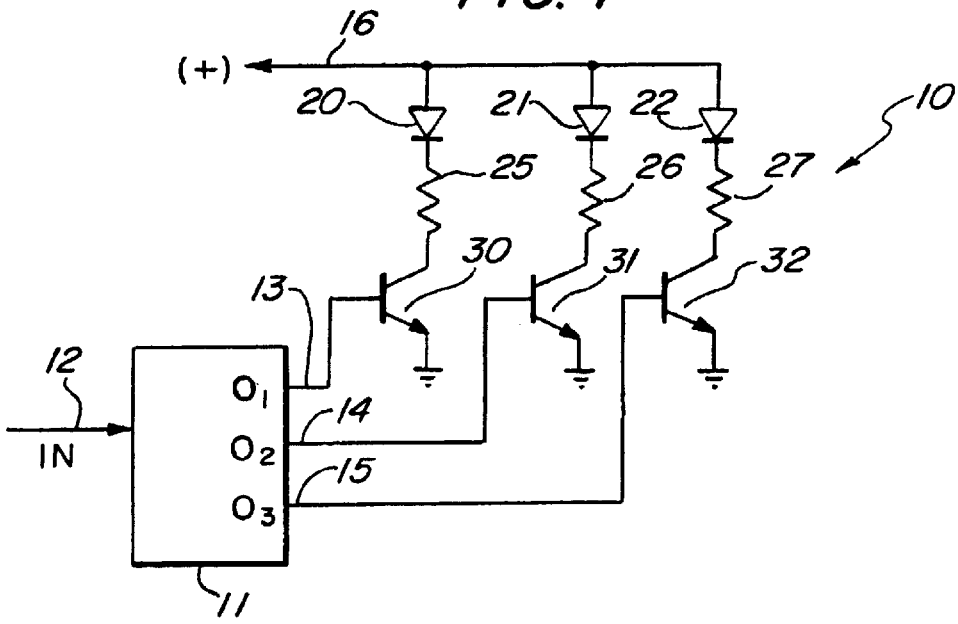
FIG. 1 sets forth a schematic diagram of an incremental color-blending illumination system constructed in accordance with the present invention having three transistor switches and three color LEDs.

FIG. 1 sets forth an incremental color-blending illumination system constructed in accordance with the present invention and generally referenced by numeral 10. System 10 includes a microcontroller 11 having an input 12 and three output terminals 13, 14 and 15. System 10 further includes a plurality of switching transistors 30, 31 and 32 each having their respective emitters connected to ground and their respective bases coupled to outputs 13, 14 and 15 of microcontroller 11. A trio of color LEDs 20, 21 and 22 are each capable of producing red, green and blue light respectively when energized. LEDs 20, 21 and 22 have their respective anodes commonly coupled to a source of operating supply voltage 16. LED 20 is coupled to the collector of transistor 30 by a current limiting resistor 25. Similarly, the cathodes of LEDs 21 and 22 are coupled to the collectors of transistors 31 and 32 by current limiting resistors 26 and 27 respectively.

The fundamental system shown in FIG. 1, and referenced as system 10, is a basic symmetrical system in that each color LED is controlled by a single current limiting resistor and switching transistor. As a result, the light produced by LEDs 20, 21 and 22 is determined by the switching states of transistors 30, 31 and 32. For example, if transistor 30 is turned on or conductive, resistor 25 is effectively coupled to ground and LED 20 is energized. The light output of LED 20 for a given positive voltage 16 is determined by the characteristics of LED 20 and the resistance of resistor 25. Similarly, conduction by transistor 31 couples resistor 26 to ground and causes a current flow through LED 21. Finally, conduction of transistor 32 couples resistor 27 to ground and causes conduction of LED 22. The combined light output both in color and illumination is determined by the light outputs of LEDs 20, 21 and 22. Since each LED produces a different color light, the blended light output of LEDs 20, 21 and 22 is controlled by the output signals of microcontroller 11 applied to the basis of switching transistors 30, 31 and 32. Thus, if output 13 is high, transistor 30 conducts and LED 20 is activated. Similarly, if output 14 is high, transistor 31 is conductive and LED 21 produces light output. Finally, if output 15 is high, transistor 32 is conductive and LED 22 produces light output.

Accordingly, with three output terminals applied to three switching transistor controlling three light emitting diodes, a total combination of seven colors of blended light output from LEDs 20, 21 and 22 is provided. The relative conduction levels of each of diodes 20, 21 and 22 is established primarily by the relative resistances provided by resistors 25, 26 and 27 in relation to the operating characteristics of diodes 20, 21 and 22.

Figure 2:
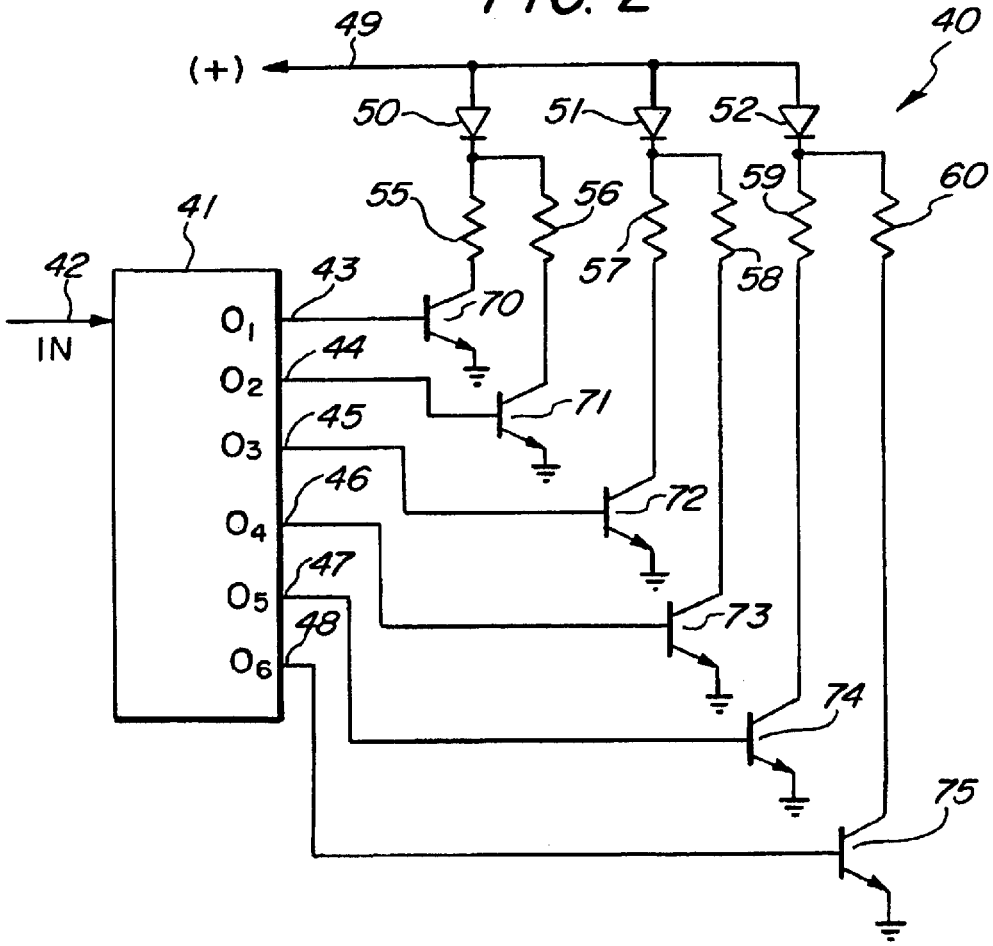
FIG. 2 sets forth a schematic diagram of an incremental color-blending illumination system constructed in accordance with the present invention having three color LEDs and six transistor switches symmetrically distributed among the color LEDs.
Figure 3:
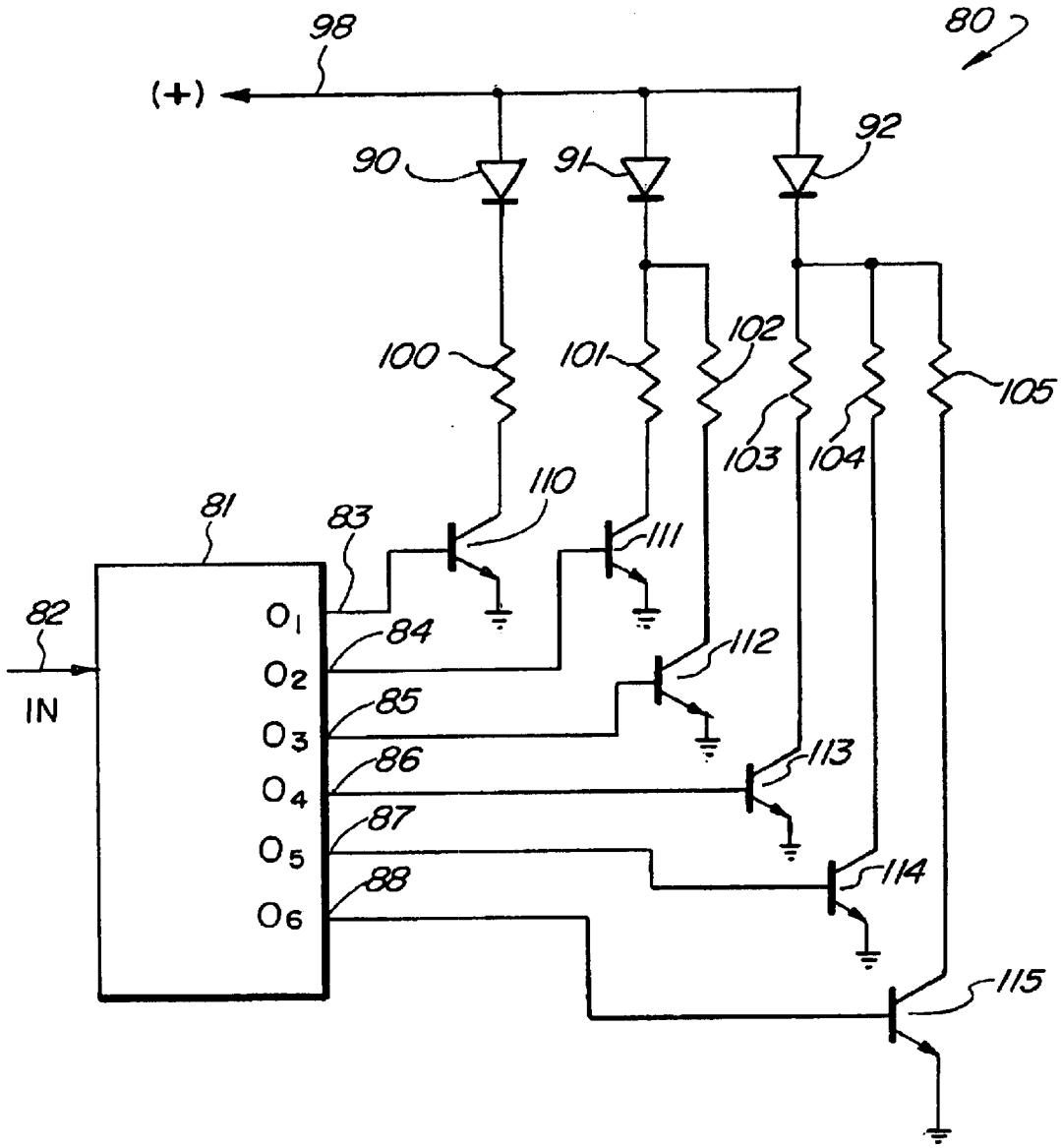
FIG. 3 sets forth a schematic diagram of an incremental color-blending illumination system constructed in accordance with the present invention having three color LEDs and six transistor switches distributed in a non-symmetrical manner between the LEDs.

System 10 is therefore capable of responding to an input signal at input 12 of microcontroller 11 to provide a combination of output signals at outputs 13, 14 and 15 to selectively or, in combination energize one or more color LEDs 20, 21 and 22 to provide incremental color blending of the combined light output. As mentioned above, the system shown in FIG. 1 and generally referenced by numeral 10 is a basic symmetrical circuit in that three color LEDs are controlled by three current limiting resistors in combination with three switching transistors. It will be apparent to those skilled in the art however that the present invention incremental color-blending illumination system is not limited to this symmetrical arrangement. FIGS. 2 and 3 set forth below show examples of systems which are capable of substantially greater numbers of color blending increments. By way of overview, the system shown in FIG. 2 provides a greater number of color blending increments while maintaining a basically symmetrical environment. In contrast, the system shown in FIG. 3 provides additional color blending increments utilizing a non-symmetrical system.

FIG. 2 sets forth a schematic diagram of an incremental color-blending illumination system constructed in accordance with the present invention and generally referenced by numeral 40. Illumination system 40 includes a microcontroller 41 having an input 42 and a plurality of outputs 43, 44, 45, 46, 47 and 48. System 40 further includes a trio of color LEDs 50, 51 and 52 having their respective anodes commonly coupled to a source of operating supply voltage 49. System 40 further includes a plurality of switching transistors 70, 71, 72, 73, 74 and 75 each having their respective emitter electrodes grounded and each having their respective base electrodes coupled to outputs 43 through 48 respectively. A current limiting resistor 55 is coupled between the collector of transistor 70 and the cathode of LED 50. A current limiting resistor 56 is coupled between the cathode of LED 50 and the collector of transistor 71. A current limiting resistor 57 is coupled between the cathode of LED 51 and the collector of transistor 72. A current limiting resistor 58 is coupled between the cathode of LED 51 and the collector of transistor 73. Finally, a current limiting resistor 59 is coupled between the cathode of LED 52 and the collector of transistor 74 while a current limiting resistor 60 is coupled between the cathode of LED 52 and the collector of transistor 75.

In operation, outputs 43 through 48 are configured by microcontroller 41 in response to an input signal at input 42. Microcontroller 41 may be fabricated in accordance with conventional fabrication techniques in which the respective output signals at outputs 43 through 48 are given either high or low voltage conditions in various combinations depending upon the input signal at input 42. The conduction level and therefore output illumination of LED 50 is established at a first conduction level by switching transistor 70 to a conducting state and allowing current to flow through resistor 55. The conduction level of LED 50 is further modified by switching transistor 71 to a conducting state and allowing current to flow through resistor 56. A third conduction level for LED 50 may be established by simultaneously switching transistors 70 and 71 to conducting states causing current to flow through the parallel combination of resistors 55 and 56. The conduction of transistors 70 and 71 is controlled by the output state of microcontroller 41 at outputs 43 and 44. In a similar fashion, the conduction level and therefore illumination output of LED 51 is controlled by transistors 72 and 73 which in turn are controlled by outputs 45 and 46 of microcontroller 41. Accordingly, a first light output is established by switching transistor 72 on and effectively coupling resistor 57 to ground while an alternative light output is established for LED 51 by turning transistor 73 on an effectively coupling resistor 58 to ground. Once again, a further light output condition is established for LED 51 by simultaneously switching transistors 72 and 73 to their on states causing a combined current to flow through resistors 57 and 58 which further changes the light output of LED 51. Finally, the conduction level and therefore light output of LED 52 is established at a first condition by switching transistor 74 to a conducting state or alternatively, at a second condition by switching transistor 75 to a conducting state or a third condition by simultaneously switching transistor 74 and 75 to their on states.

It will be apparent to those skilled in the art that the use of six output terminals controlling the switching conditions of six switching transistors and six current limiting resistors coupled in pairs to three LEDs provides a total capability for incremental color blending which yields a total of sixty different color combinations. Thus, in response to an input signal at input 42 of microcontroller 41, the appropriate output states for outputs 43 through 48 may be established to cause LEDs 50, 51 and 52 to provide relative conductions which generate any one of sixty available color blending combinations. The color blending is now more finally incremented in comparison to the circuit of FIG. 1. However, the basic operation remains the same.

FIG. 3 sets forth a non-symmetrical embodiment of the present invention incremental color-blending illumination system generally referenced by numeral 80. Illumination system 80 includes a microcontroller 81 having an input 82 and a plurality of outputs 83 through 88. System 80 further includes a trio of color LEDs 90, 91 and 92 having their respective anodes commonly coupled to a source of operating supply voltage 93. A transistor 110 has its base coupled to output 83, its emitter coupled to ground and its collector coupled to the cathode of LED 90 by a current limiting resistor 100. A pair of transistors 111 and 112 have their respective emitters grounded and their respective basis coupled to outputs 84 and 85 of microcontroller 81. Transistors 111 and 112 have their respective collectors coupled to the cathode of color LED 91 by a pair of current limiting resistors 101 and 102. A trio of switching transistors 113, 114 and 115 has their respective emitters grounded and their respective bases coupled to outputs 86, 87 and 88. The collectors of transistors 1 13, 114 and 1 15 are coupled to the cathode of color LED 92 by current limiting resistors 103, 104 and 105 respectively. In operation, illumination system 80 is similar in function to the above-described symmetrical systems in that the conduction levels and therefore light outputs of color LEDs 90, 91 and 92 are controlled by switching transistors and current limiting resistors. The difference in illumination system 80 is the non-symmetrical transistor and current limiting resistor couplings to the color LEDs. Thus, the conduction level and therefore illumination output of color LED 90 is controlled entirely by resistor 100 and the switching of transistor 1 10. In contrast, the conduction and therefore illumination output of color LED 91 is established by either or both of transistors 111 and 1 12 conduction. A first conduction level is established by turning transistor 111 on while a second conduction level is established by turning transistor 1 12 on and a third conduction level is established by turning transistors 111 and 112 on simultaneously. Thus, in illumination system 80, color LED 91 is capable of three different illumination output levels in response to the operating conditions of transistors 111 and 112. By way of comparison, it is noted that the illumination output of color LED 90 is capable of a single illumination level determined by the operative condition of transistor 110. In a similar fashion, the conduction and therefore illumination output of color LED 92 is determined by the operating conditions of transistors 113, 114 and 115. With transistor 113 conducting, a first illumination level is established for color LED 92 by conduction through resistor 103. A second conduction level is established by turning on transistor 114 and the conduction through 104. A third conduction level is established by turning on transistor 115 and the conduction of resistor 105. A fourth conduction level is established by simultaneously turning on transistors 113 and 114 placing resistors 103 and 104 in parallel. A fifth operating condition is established by simultaneously turning on transistors 113 and 115 placing resistors 103 and 105 in parallel and finally a sixth condition is established by simultaneously turning on transistors 114 and 115 placing resistors 104 and 105 in parallel.

Thus, in the operation of system 80, the incremental control of color light output from color LED 90 enjoys a single increment while the colored light output of color LED 91 enjoys three illumination increments while color LED 92 enjoys a total of six possible increments of colored light output. As a result, it will be apparent that the output of LED 90 is very coarsely controlled having a single output increment while the output of color LED 91 is more finely controlled having three illumination increments and the output of color LED 92 is very finely controlled having six possible incremental output levels. As a result, the control available in system 80 provides for substantial flexibility in more finally controlling certain color illumination levels relative to other illumination levels.

It will be apparent to those skilled in the art from the foregoing descriptions that the present invention system is not limited to any particular number of incremental controls for each and every color LED in the illumination system. It will be equally apparent to those skilled in the art that the present invention incremental color-blending illumination system is not limited to the use of three color LEDs. It will be recognized that the use of three color LEDs which, may for example, be red, blue and green light producing LEDs is a convenient and flexible system. However, a smaller or greater number of LEDs may be used without departing from the spirit and scope of the present invention.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An incremental color-blending illumination system comprising:

a plurality of color LEDs each having a first electrode coupled to a source of operation supply and a second electrode;

a plurality of transistor switches;

a plurality of resistors coupling said transistor switches to said second electrodes; and a microcontroller having a plurality of outputs coupled to said plurality of switching transistors, said microcontrolled providing incremental color blending of light produced by said color LEDs by selectively activating one or more of said switching transistors.

2. The incremental color-blending illumination system set forth in claim 1 wherein said plurality of color LEDs include a trio of color LEDs each producing a different color light when activated.

3. The incremental color-blending illumination system set forth in claim 2 wherein at lease one of said color LEDs is coupled to a plurality of said resistors.

4. The incremental color-blending illumination system set forth in claim 2 wherein said microcontroller includes three outputs each coupled one of said switching transistors.

5. The incremental color-blending illumination system set forth in claim 2 wherein said plurality of resistors and switching transistors are coupled in pairs to each of said color LEDs.

6. An incremental color-blending illumination system comprising:

a plurality of color LEDs;

a plurality of switching elements;

a plurality of resistors; and a microcontroller coupled to said switching elements, each of said resistors and switching elements being serially coupled to said color LED, said microcontroller selectively activating said switching elements to incrementally blend the illumination of said color LEDs.

7. The incremental color-blending illumination system set forth in claim 6 wherein said switching elements are transistors.

* * * * *